US009834936B2

(12) United States Patent
Lenney

(10) Patent No.: US 9,834,936 B2
(45) Date of Patent: Dec. 5, 2017

(54) GUTTER DEBRIS PRECLUSION DEVICE WITH MULTIPLE MANIPULATIONS AND PATTERNS THEREOF

(71) Applicant: GutterGlove, Inc., Rocklin, CA (US)

(72) Inventor: Robert C Lenney, Lincoln, CA (US)

(73) Assignee: GUTTERGLOVE, INC., Roseville, CA (US)

( * ) Notice: Subject to any disclaimer, the term of this patent is extended or adjusted under 35 U.S.C. 154(b) by 0 days.

(21) Appl. No.: 14/828,201

(22) Filed: Aug. 17, 2015

(65) Prior Publication Data

US 2016/0168856 A1 Jun. 16, 2016

Related U.S. Application Data

(63) Continuation of application No. 14/453,783, filed on Aug. 7, 2014, now abandoned.

(60) Provisional application No. 61/863,366, filed on Aug. 7, 2013.

(51) Int. Cl.

| | |
|---|---|
| ***E04D 13/076*** | (2006.01) |
| ***E04B 1/92*** | (2006.01) |
| ***E04D 13/04*** | (2006.01) |
| ***E04D 13/064*** | (2006.01) |

(52) U.S. Cl.

CPC ..... *E04D 13/076* (2013.01); *E04B 1/92* (2013.01); *E04D 13/0404* (2013.01); *E04D 13/064* (2013.01)

(58) Field of Classification Search

CPC . E04D 13/072; E04D 13/076; E04D 13/0404; E04D 13/064; E04B 1/92

USPC ..... 52/11–16; 210/154, 459, 473

See application file for complete search history.

(56) References Cited

U.S. PATENT DOCUMENTS

| | | | | |
|---|---|---|---|---|
| 546,042 | A | 9/1895 | Van Horn | |
| 1,597,503 | A * | 8/1926 | Andrews | E04D 13/076 52/12 |
| 1,732,058 | A * | 10/1929 | Martini | E04D 13/076 210/474 |
| 2,229,381 | A * | 1/1941 | Grow | E04D 13/076 52/12 |
| 2,288,121 | A * | 6/1942 | Sandmeyer | E04D 13/076 248/48.2 |
| 2,583,422 | A * | 1/1952 | Haddon | E04D 13/076 210/474 |
| 3,428,183 | A * | 2/1969 | Bristow | E04D 13/076 210/474 |
| 3,691,343 | A * | 9/1972 | Norman | E04D 13/103 165/47 |
| 4,308,696 | A * | 1/1982 | Schroeder | E04D 13/0762 219/213 |
| 4,435,466 | A * | 3/1984 | Kuhnel | B32B 25/10 428/215 |

(Continued)

FOREIGN PATENT DOCUMENTS

WO 99/53157 A1 10/1999

*Primary Examiner* — Babajide Demuren

(74) *Attorney, Agent, or Firm* — Jonathan A. Kidney; CKR Law

(57) ABSTRACT

A gutter debris preclusion device for use with a gutter attached to a building, comprising a screen having a plurality of manipulations, which cause resting debris to be elevated off the surface of the screen. The elevated debris resultingly become more rapidly dried and more easily removed by the wind.

20 Claims, 10 Drawing Sheets

(56) References Cited

U.S. PATENT DOCUMENTS 4,646,488 A * 3/1987 Burns ..... E04D 13/0459 52/12
4,745,710 A * 5/1988 Davis ..... E04D 13/076 210/473
4,755,229 A * 7/1988 Armanini ..... C09B 63/00 106/413
4,769,526 A * 9/1988 Taouil ..... E04D 13/103 219/213
4,827,886 A * 5/1989 Maeda ..... F02P 7/067 123/476
4,841,686 A * 6/1989 Rees ..... E04D 13/076 210/474
4,949,514 A * 8/1990 Weller ..... E04D 13/076 210/474
5,010,696 A * 4/1991 Knittel ..... E04D 13/076 210/474
5,044,581 A * 9/1991 Dressler ..... E04D 13/076 248/48.1
5,095,666 A * 3/1992 Williams, Jr. ..... E04D 13/076 210/474
5,107,635 A * 4/1992 Carpenter ..... E04D 13/076 210/474
5,127,200 A * 7/1992 Doran ..... E04D 13/076 15/160
5,261,195 A * 11/1993 Buckenmaier ..... E04D 13/0459 52/12
5,325,090 A * 6/1994 Goeldner ..... H04L 12/5601 340/2.22
5,391,858 A * 2/1995 Tourangeau ..... E04D 13/0762 165/47
5,398,464 A * 3/1995 Jacobs ..... E04D 13/076 248/48.1
5,406,754 A * 4/1995 Cosby ..... E04D 13/076 52/12
5,438,803 A * 8/1995 Blizard, Jr. ..... E04D 13/076 210/474
5,558,705 A * 9/1996 Keemer ..... C09C 1/644 106/403
5,617,678 A * 4/1997 Morandin ..... E04D 13/0725 248/48.2
5,640,809 A * 6/1997 Iannelli ..... E04D 13/076 210/474
5,729,931 A * 3/1998 Wade ..... E04D 13/076 248/48.2
5,759,255 A * 6/1998 Venturini ..... C09C 3/12 106/417
5,878,533 A * 3/1999 Swanfeld, Jr. ..... E04D 13/0762 219/213
5,893,240 A * 4/1999 Ealer, Sr. ..... E04D 13/076 248/48.2
6,134,843 A * 10/2000 Tregear ..... E04D 13/076 210/474
6,194,049 B1 * 2/2001 Bindschedler-Galli . B32B 27/08 156/244.19
6,194,519 B1 * 2/2001 Blalock ..... C08L 19/003 524/444
6,205,715 B1 * 3/2001 Rex, Jr. ..... E04D 13/076 52/12
6,225,600 B1 * 5/2001 Burris ..... E04D 13/0762 219/213
6,341,462 B2 * 1/2002 Kiik ..... E04D 13/0762 428/430
6,598,352 B2 7/2003 Higginbotham
6,607,781 B2 * 8/2003 Joedicke ..... C04B 20/1085 427/186
6,700,098 B1 * 3/2004 Wyatt ..... E04D 13/0762 219/213
6,708,452 B1 * 3/2004 Tenute ..... E04D 13/0762 219/213
6,745,516 B2 * 6/2004 Beyers ..... E04D 13/076 52/12
6,759,630 B1 * 7/2004 Tenute ..... E04D 13/103 219/213
6,933,007 B2 8/2005 Fensel et al.
6,942,419 B2 * 9/2005 Knak ..... E03F 5/06 210/163
6,951,077 B1 * 10/2005 Higginbotham ..... E04D 13/076 210/499
6,959,512 B2 * 11/2005 Cobb ..... E04D 13/0481 219/213
7,104,012 B1 * 9/2006 Bayram ..... E04D 13/076 219/213
7,174,688 B2 2/2007 Higginbotham
7,191,564 B2 * 3/2007 Higginbotham ..... E04D 13/076 210/474
7,241,500 B2 7/2007 Shiao et al.
7,310,912 B2 * 12/2007 Lenney ..... E04D 13/076 210/162
7,448,167 B2 11/2008 Bachman
7,624,541 B2 * 12/2009 Gentry ..... E04D 13/076 248/48.1
7,913,458 B2 3/2011 Higginbotham
7,975,435 B2 * 7/2011 Lenney ..... E04D 13/076 52/11
8,033,058 B2 * 10/2011 Block ..... E04D 13/08 210/162
8,079,183 B2 * 12/2011 Lenney ..... E04D 13/0762 219/213
8,438,787 B2 5/2013 Lenney et al.
8,479,454 B2 * 7/2013 Lenney ..... E04D 13/076 248/48.1
8,572,899 B1 * 11/2013 Pearce ..... E04D 13/076 428/209
8,677,694 B2 * 3/2014 Ash ..... E04D 13/076 210/154
2003/0046876 A1 * 3/2003 Higginbotham ..... E04D 13/076 52/11
2003/0198736 A1 * 10/2003 Fensel ..... B32B 5/16 427/186
2005/0072114 A1 * 4/2005 Shiao ..... E04D 5/12 52/782.1
2005/0279036 A1 * 12/2005 Brochu ..... E04D 13/076 52/287.1
2006/0037252 A1 * 2/2006 Gosse ..... E04D 13/0762 52/11
2006/0117670 A1 * 6/2006 Tsioris ..... E04D 13/076 52/11
2006/0196124 A1 * 9/2006 Bachman ..... E04D 13/076 52/12
2006/0213129 A1 * 9/2006 Bachman ..... E04D 13/0762 52/11
2006/0230687 A1 * 10/2006 Ealer, Sr. ..... E04D 13/076 52/12
2006/0277831 A1 * 12/2006 Bachman ..... E04D 13/0762 52/11
2006/0283096 A1 * 12/2006 Bachman ..... E04D 13/0762 52/11
2007/0054129 A1 * 3/2007 Kalkanoglu ..... B32B 5/022 428/413
2007/0065640 A1 * 3/2007 Joedicke ..... C04B 20/1059 428/143
2007/0094939 A1 * 5/2007 Bachman ..... E04D 13/0762 52/11
2007/0107323 A1 5/2007 Higginbotham
2007/0199276 A1 * 8/2007 Duque ..... E04D 1/34 52/741.4
2007/0218251 A1 * 9/2007 Jacobs ..... B32B 5/16 428/143
2007/0234647 A1 * 10/2007 Higginbotham ..... E04D 13/076 52/12
2007/0246449 A1 * 10/2007 Bachman ..... E04D 13/0762 219/213
2008/0187708 A1 * 8/2008 Decker ..... B05D 5/061 428/98
2008/0248241 A1 * 10/2008 Kalkanoglu ..... B32B 11/10 428/141

(56) References Cited

U.S. PATENT DOCUMENTS

| | | | | |
|---|---|---|---|---|
| 2009/0056234 | A1* | 3/2009 | Brochu | E04D 13/076 52/12 |
| 2009/0064628 | A1* | 3/2009 | Mellott, II | B32B 11/10 52/717.05 |
| 2010/0042579 | A1* | 2/2010 | Larsen | G06F 17/30 711/163 |
| 2011/0067318 | A1* | 3/2011 | Lenney | E04D 13/076 52/12 |
| 2011/0138698 | A1* | 6/2011 | Neumann | E04D 13/076 52/12 |
| 2011/0253611 | A1 | 10/2011 | Higginbotham | |
| 2012/0042579 | A1* | 2/2012 | McCoy | E04D 13/076 52/12 |
| 2012/0132759 | A1* | 5/2012 | Sager | E04D 13/0762 248/49 |
| 2014/0026494 | A1* | 1/2014 | Iannelli | E04D 13/076 52/12 |

* cited by examiner

GUTTER DEBRIS PRECLUSION DEVICE WITH MULTIPLE MANIPULATIONS AND PATTERNS THEREOF

CROSS REFERENCE TO RELATED APPLICATION

This application is a nonprovisional continuation application of U.S. application Ser. No. 14/453,783 filed on Aug. 7, 2014, which is a nonprovisional of U.S. Provisional Application No. 61/863,366 filed on Aug. 7, 2013, to which priority is claimed to each of these applications and the substance of each application is incorporated herein by reference in their respective entireties.

BACKGROUND OF THE INVENTION

1. Field of Invention

This invention relates to barriers for rain gutters for keeping leaves and other debris out of the rain gutters. More particularly, this invention relates to rain gutter debris preclusion barriers, which utilize a screen.

2. Description of Related Art

Prior gutter debris preclusion devices have been effective in preventing debris from passing through the screen and entering the gutter. Such devices are disclosed in U.S. Pat. No. 7,310,912 (the '912 patent) and U.S. Pat. No. 8,479,454 (the '454 patent) both issued to Robert C. Lenney and John Lewis. U.S. Pat. Nos. 7,310,912 and 8,479,454 are incorporated herein by reference, in their respective entireties.

Despite the effectiveness of the devices taught by the '912 and '454 patents, there are still areas for enhancement and modification to those devices. The present disclosure addresses some of these areas for modification, such as in the area of increasing the effectiveness of screening out of debris, while at the same time enhancing the channeling of the water flow over and through the screen.

This present disclosure overcomes the drawbacks and shortcomings of prior art conventional devices. These and other features and advantages are described in, or are apparent from, the following detailed description of various exemplary embodiments of the devices and methods thereof.

SUMMARY OF THE INVENTION

The following presents a simplified summary in order to provide a basic understanding of some aspects of the claimed subject matter. This summary is not an extensive overview, and is not intended to identify key/critical elements or to delineate the scope of the claimed subject matter. Its purpose is to present some concepts in a simplified form as a prelude to the more detailed description that is presented later.

The present invention provides a screen for use with gutter debris preclusion devices, wherein the screen includes various sequences/patterns of manipulations to allow water to pass into the gutter, while elevating precluded debris to accelerate its drying and removal from the gutter system.

In one aspect of the disclosed embodiments, a device for a gutter debris preclusion device that is for use with a gutter is provided. The device includes a screen having orifices, wherein the screen includes a first manipulation being formed in the screen and having a first cross-sectional shape and a first longitudinal shape and wherein the screen includes a second manipulation being formed in the screen and having a second cross-sectional shape and a second longitudinal shape, and the screen includes a first pattern being formed by the first and second manipulations.

In another embodiment of the invention, the first cross-sectional shape is the same as the second cross-sectional shape. Still further in another embodiment, the first longitudinal shape is the same as the second longitudinal shape. Yet in other embodiments, the first cross-sectional shape is the same as the second cross-sectional shape, and the first longitudinal shape is different than the second longitudinal shape. In other exemplary embodiments, the first cross-sectional shape is different than the second cross-sectional shape, and the first longitudinal shape is the same as the second longitudinal shape. Still further, in other embodiments, the screen further includes a second pattern being formed from at least two additional manipulations. In other embodiments, the first pattern and the second pattern are of the same overall shape and yet in other embodiments first pattern and the second pattern are not of the same overall shape. In an exemplary embodiment, the first longitudinal shape forms a sinusoidal curve.

In another aspect of the disclosed embodiments, the present invention provides a gutter debris preclusion device for securing to a top portion of a roof gutter that is attached to a building for keeping leaves and other debris out of the roof gutter. The device of the present invention includes a screen with fenestrations allowing water to pass through into the roof gutter, and a first manipulation and second manipulation integrally and one-piece formed of a portion of the screen, the first manipulation having a two-dimensional first cross section and a first length, the second manipulation having a two-dimensional second cross section and a second length; wherein at least the first and second manipulations contain an elevated region that is at least 0.125 inches tall and provides a tilt angle of between 0 to 45 degrees for leaves or similar debris resting on the screen; wherein the first and second cross sections of the manipulations are extended along the first and second lengths to form a pattern of manipulations along the screen; wherein the manipulations' cross sections causes any resting debris to be more easily dried and blown off the roof gutter.

In another embodiment of the invention the first and second manipulations form a group or set of manipulations. Still further in other embodiments, the group or set of manipulations is repeated to form one or more patterns. In other exemplary embodiments, at least one of the groups of manipulations and patterns is repeated in a uniform manner or non-uniform manner. Yet still further in other embodiments, a cross section of at least one of the first and second manipulations is at least one of a truncated rectangle, a plurality of adjoining truncated rectangles displaced from each other by a fixed separation distance, a plurality of truncated rectangles that are multi-sized, a plurality of adjoining arcs, a plurality of adjoining angles, a plurality of truncated trapezoids, an S-shape, a circle, and a plurality of concentric circles. In other exemplary embodiments, the screen is between approximately 5 inches to 10 inches wide. Still further in some embodiments, the screen further comprises a plurality of reinforcing structures to support the screen. In other embodiments, the screen is arched to be self-supporting. Still further in some embodiments, one or more groups or patterns is displaced and repeated from a prior group or pattern to intersect the prior group or pattern. In other embodiments, one or more groups or patterns is displaced and repeated from a prior group or pattern at a dissimilar angle. Still further in other embodiments, the group or pattern form a shape of at least one of a cross hatch, an S, a tile, a zig-zag, a brick, a block, an accordion, and circles. Yet in other embodiments, the screen is tiered with an upper portion and a lower portion, wherein at least one of the first and second manipulations span the upper and lower portion, and wherein at least one of the first and second manipulations is constrained to either the upper portion or lower portion.

In yet another aspect of the disclosed embodiments, the present invention provides a method for gutter debris preclusion for use with a gutter. In one exemplary embodiment the method includes installing a gutter debris preclusion device to a gutter, wherein the device includes a screen having orifices, wherein the screen includes a first manipulation being formed in the screen and having a first cross-sectional shape and a first longitudinal shape, wherein the screen includes a second manipulation being formed in the screen and having a second cross-sectional shape and a second longitudinal shape, and the screen includes a first pattern being formed by the first and second manipulations.

These and other features and advantages of this invention are described in, or are apparent from, the following detailed description of various exemplary embodiments of the devices and methods according to this invention.

BRIEF DESCRIPTION OF THE DRAWINGS

Various exemplary embodiment of this invention will be described in detail, with reference to the following figures, wherein.

DETAILED DESCRIPTION OF THE FIGURES

Figure 1:
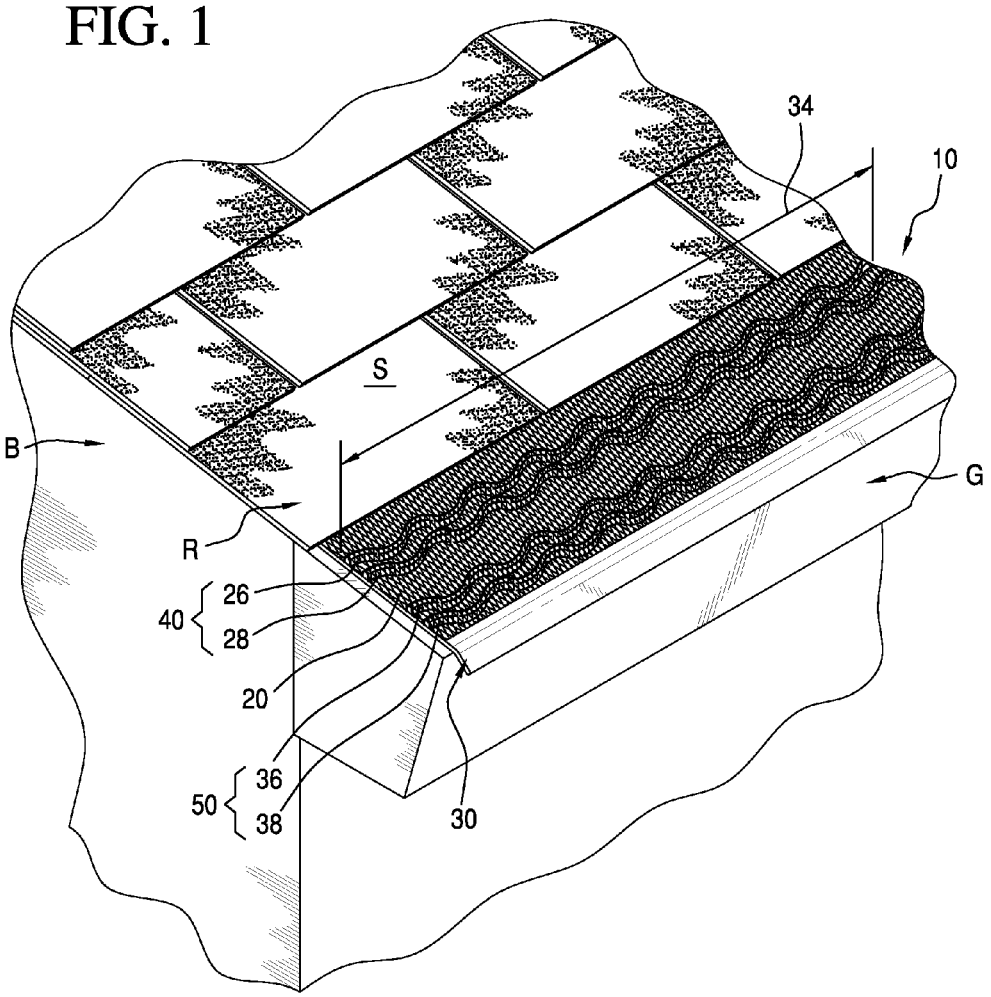
FIG. 1 displays a partial perspective view of a debris preclusion device or gutter guard in accordance with an embodiment of the present invention.

Various aspects of the disclosed embodiments describe barriers or features of barriers for rain gutters and similar structures for keeping leaves and other debris out of the rain gutters. Gutter debris preclusion of the present invention is facilitated by having at least one manipulation on a screening mesh element that extends over the top of a gutter. The manipulation provides a resting surface that extends above the mesh. The resting surface of the manipulation holds up a portion or entirety of the leaves (debris) above the main flat portions of the mesh so that the debris is not lying flat on the mesh and thus allowing the flow of air beneath the debris. The air can dry the leaves (debris) out faster and also create opportunities for the debris to blow off the gutter debris preclusion device easier. Another purpose of the manipulations in some various embodiments in the screening filter is to give the gutter debris preclusion device support to span the gutter without the need for an under support.

The manipulations in the screen create raised resting areas that hold up leaves and pine needles at 0 to 45 degree angles. For typical residential gutters, this can be accomplished by having a height of the ridge at least about 0.125 inches from the surface of the screen. In some embodiments, multiple ridges (or manipulations) can be used to form uniform and non-uniform groups/patterns of raised areas (ridges) in the screen. The groups/patterns of the multiple ridges/manipulations can be spaced apart to suit different applications. The spacing can be sufficiently close enough to completely raise a typically sized pine needle above the screen's non-ridged surface. For example, the ridges may be spaced about one to two inches from each other. In other embodiments geared for leaves (versus pine needles) the ridges can be closer together. Each manipulation can have one of many cross-sectional shapes. Each manipulation within the pattern can have different cross-sectional shapes. The height of each of the manipulations from the surface of the screen can be uniform or non-uniform depending upon the embodiment. In some exemplary embodiments, the height of the manipulation can be at least about 0.25 inches from the surface of the screen, and analogously spaced, if so desired, to completely raise a typically sized leaf above the screen's non-ridged surface. In some embodiments, it will be sufficient to only require one end of the leaf/pine needle to be raised, so spacing of the manipulations may be altered as such. For commercial (larger) gutters, the respective sizes may be adjusted to accommodate the expanded screen size.

When debris is held up at these angles, it makes the debris easier for wind to pass under the debris and dry out the leaves (debris) quicker. It also allows for the debris to blow off easier. Flat mesh screens without any types of ridges allow debris to cling to the mesh more easily and discourages debris from blowing off. When debris is not given the opportunity to dry or blow off, it can disrupt and block the flow of water by blocking entry into the screen.

Also, flat mesh screens tend to become clogged with micro-debris (for example, shingle asphalt grains, dirt, decomposed leaf pieces, etc.) over a period of time. With manipulations, more surface area is available for the water to travel through; therefore, even if there is micro-debris clogging a portion of the mesh screen, the increased surface area enables the barrier to still operate effectively. For example, a common problem with typical flat meshes is that when debris accumulates, the debris "blocks" the water from entering the gutter, which can result in the water being redirected by the debris and sent, sometimes, off the gutter. With increased surface area of the screen due to the patterns of manipulations, the redirected water can be channeled to other parts of the mesh screen (which may not be debris-blocked) and appropriately directed into the gutter. Depending on the type of pattern of manipulation chosen, the surface area can be increased up to 100% or more over conventional flat meshes.

Further, the physical orientation and structure of the manipulations can create a localized water damming effect for oncoming water that increases water turbulence so as to dislodge micro-debris and/or regular debris as well as channel water further along other portions of the mesh screen that are not dammed, affording increased area for the water to filter through. Additionally, various manipulations (including combinations of different manipulations, or arrangements thereof) may be of a particular dimension/orientation or size to effectively operate to channel water "indirectly" from lip-to-lip of the gutter, so as to provide a longer path for the water to filter through. Conversely, various manipulations may be of a particular dimension/orientation or size to channel the debris "directly" from lip-to-lip, so as to form a shorter path for the debris to travel (allowing it less surface area for the debris to be trapped).

Therefore, the redirection of the flow of water provides a mechanism to reduce the possibility of water planing over the surface of the barrier off the gutter, which is commonly seen during heavy downpours. Further, the patterns of raised manipulations decrease the speed of the flow of water over the screen and thereby enhancing the volume of water entering the gutter through the screen.

As shown in the following side-view drawings, the manipulations in the mesh screen can be of any shape, whether geometric or not. Examples of various possible manipulation shapes are now described.

Referring to the drawings, wherein like reference numerals represent like parts throughout the various drawing figures, FIG. 1 displays a partial perspective view of a debris preclusion device or gutter guard 10, made in accordance with an embodiment of the present invention. The device 10 is shown in use on a gutter G attached to a building B, adjoining the edge of roof R that is covered by shingles S. The device 10 extends from the shingles to at least a gutter lip of the gutter G. The device 10 includes a screen 20 and a gutter channel 30. Water traveling off of shingles S pass onto the screen (or mesh) 20. The screen 20 includes a first manipulation 26 and a second manipulation 28. The screen 20 includes a third manipulation 36 and a fourth manipulation 38. The screen 20 further includes a first group of manipulations 40, which includes the first manipulation 26 and the second manipulation 28. The screen 20 includes a second group of manipulations, which includes the third manipulation 36 and the second manipulation 38. The first and second groups of manipulations 40 and 50 form patterns on the screen 20. It should be appreciated that in other exemplary embodiments each group or pattern consists of a multitude of manipulations.

Figure 2:
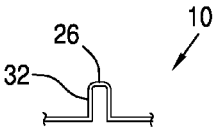
FIG. 2 displays a cross-section of one possible manipulation shape for a portion of the device of FIG. 1, having a manipulation composed of a single elevated "flattened" ridge.

The manipulations 26, 28, 36 and 38 each have a cross-sectional shape. Further each manipulation 26, 28, 36 and 38 has a longitudinal shape (the shape along the length of the manipulation). The manipulations 26, 28, 36 and 38 are preferably formed integrally in the screen. The screen is bent to form the manipulations. FIG. 2 displays the cross-sectional shape of the first manipulation 26. It has a cross-sectional height 32. The first manipulation 26 has a longitudinal shape 34, as shown in FIG. 1. It should be appreciated that the second, third and forth manipulations in this embodiment have the same cross-sectional shape and the longitudinal shape as the first manipulation 26. It should be appreciated that in other exemplary embodiments, the screen includes additional manipulations. It should be further appreciated that in other exemplary embodiments there are only two manipulations. Still further, it should be appreciated that at least two of the manipulations have different cross-sectional shapes. It should also be appreciated that in other exemplary embodiments, at least two of the manipulations have longitudinal shapes that are of different shapes, where the first and second groups 40 and 50 form patterns on the screen 20.

The manipulations 26, 28, 36 and 38 are each generally of a vertical protrusion of the mesh material, being integral and forming a single piece with the screen 20. The manipulations

26, 28, 36 and 38 operate to elevate an end of resting debris from the surface of the non-elevated portion of the screen 20.

For convenience, the roof R is considered to include all portions of the covering of a building except for the shingles S. The shingles S are considered to include the uppermost layer of material, and can be "composite" shingles, tile, wood shake, slate, stone, or any other roofing material available to provide the uppermost layer.

Any debris falling off of the shingles S and onto the screen 20 of the device 10 either remain upon the device 10 or fall off of the screen 20 and away from the gutter G so that the gutter G can remain free of debris and function properly. As noted above, manipulations 26, 28, 36 and 38 are of a shape that provides a reduced horizontal planar surface for debris to cling to. While the manipulations 26, 28, 36 and 38 in this embodiment are shown as substantially parallel with the length of the gutter G and to a longitudinal edge of the screen, it should be appreciated that in other embodiments, the manipulations can be of any orientation with respect to the gutter G. Even further, it should be appreciated that in other embodiments, the manipulation, or groups formed by one or more manipulations, or patterns (arrangements of a group or groups of manipulations, or individual manipulations) can be arranged to be non-orthogonal to the length of the gutter G, so as to be at a repeating angle along the length of the gutter G.

The screen 20 can be any form of fenestrated structure capable of allowing water to pass therethrough but blocking debris from passing therethrough. The screen 20 is preferably formed of a flexible material with uniformly sized fenestrations. Most particularly, the screen 20 is formed of stainless steel woven wire with the fenestrations in the screen 20 sized to provide approximately 8,000 holes per square inch. It should be appreciated that materials other than stainless steel can be utilized. With such small fenestrations, twigs, sand and leaf stems are precluded from sticking in the fenestrations, and practically all debris harmful to the proper functioning of the gutter G is precluded from passing therethrough. It should be appreciated that the wire can have as few as 196 holes and as many as 8,200 holes per square inch. In certain areas on the roof, such as the valleys where there is a great volume of rainwater flow, fewer holes are recommended because they allow more rainwater to pass through at higher volumes. However, in other areas where rainwater does not come down in high volumes off the roof, such as on straight runs, a higher number of holes can be more appropriate, such as for example 8,000 holes per square inch. The advantage of having a higher number of holes per square inch is that it can keep smaller debris out of the gutter, such as pollen, or very fine roof sand grit particles.

Figure 1A:
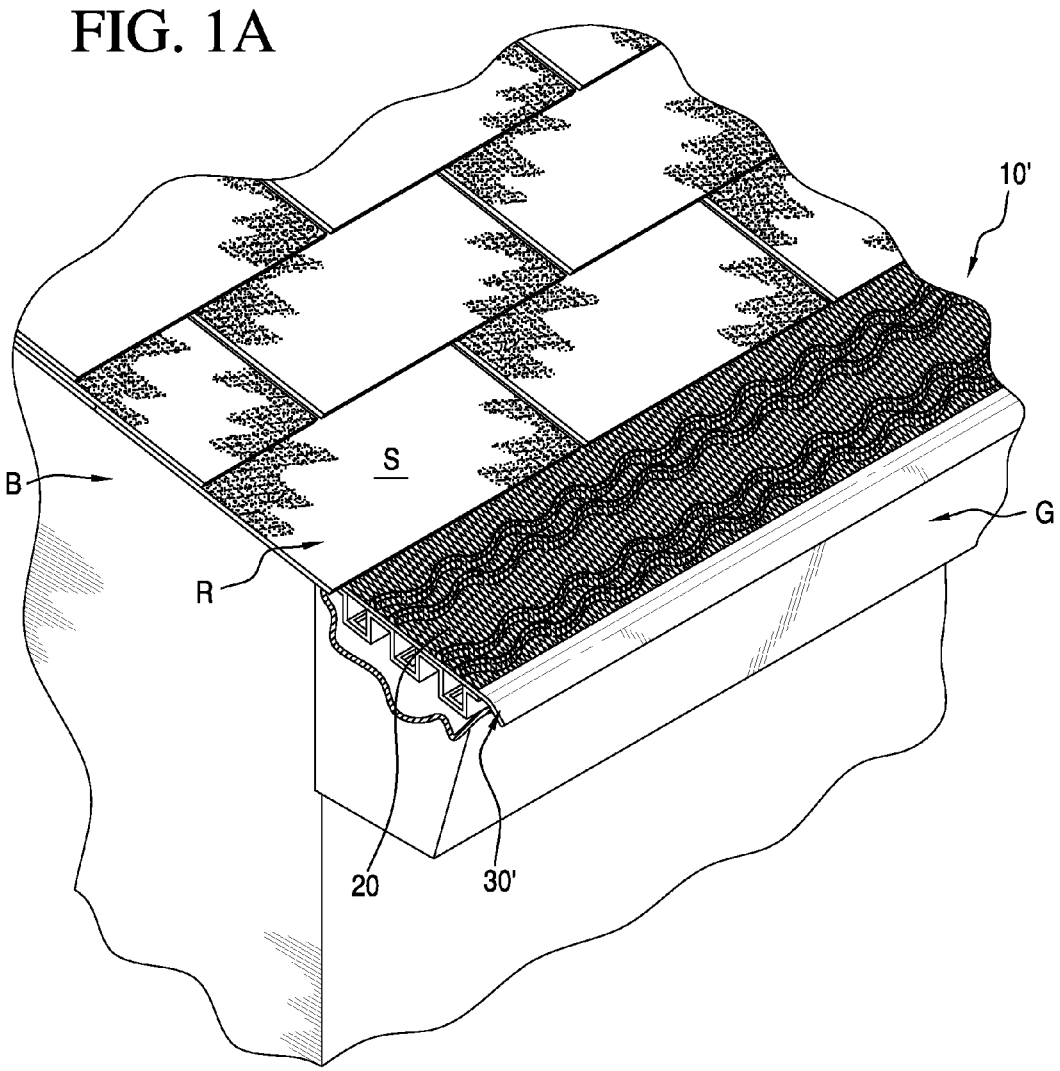
FIG. 1A displays an embodiment of FIG. 1 with a supporting frame.
Figure 1B:
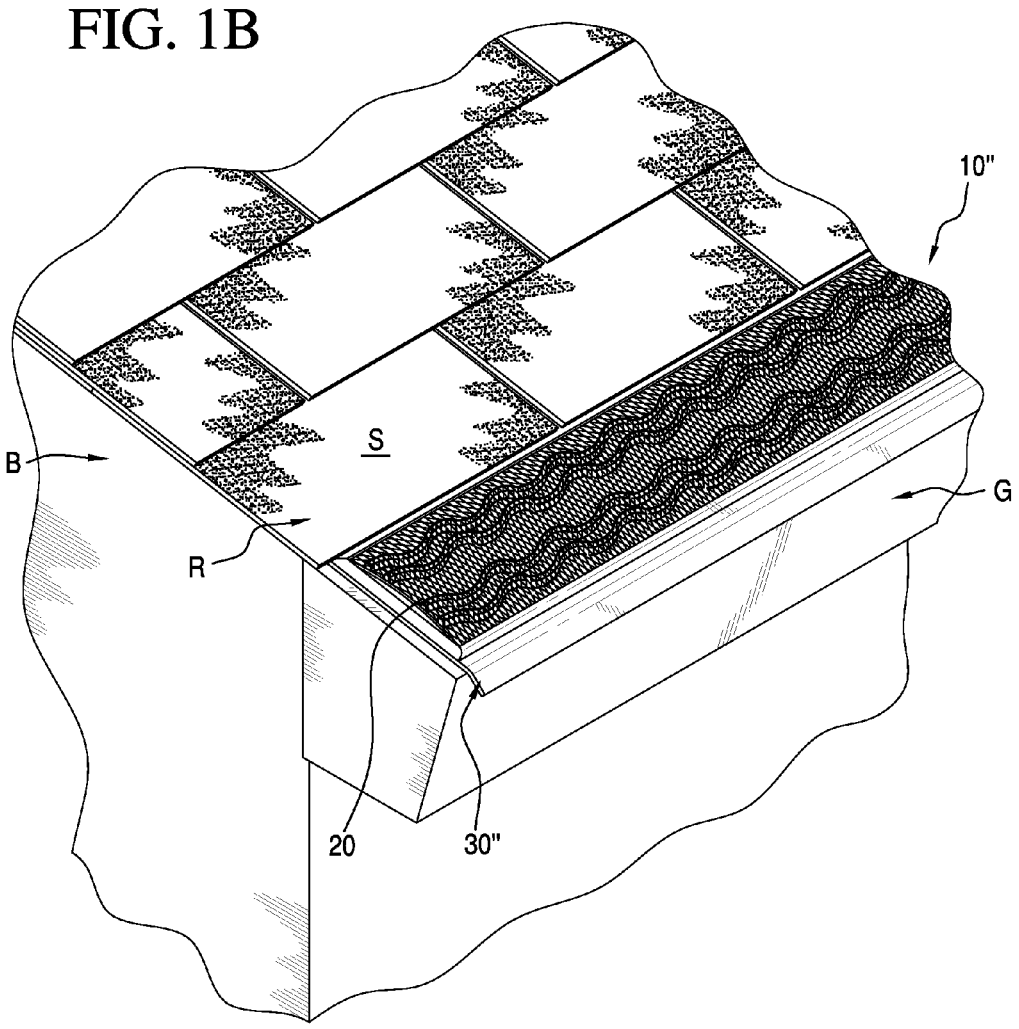
FIG. 1B displays an embodiment of FIG. 1 with an arched configuration.

Further, the screen 20 is positioned over the gutter G, when in use. The gutter channel 30, which in this embodiment assists with holding the screen 20 in position over the gutter G. The gutter channel 30 also provides for mounting of the device 10 upon the gutter G. In this embodiment, the screen is self supporting over the span of the gutter G. It should be appreciated that in other exemplary embodiments, the screen 20 may be supported over the gutter in a variety of configurations. For example, as shown in FIG. 1A, the screen 20 is shown in use with device 10', which includes a rigid support structure 30' that spans the gap of the gutter G. The screen 20 rests upon the rigid support structure 30', similar to the devices disclosed in the '454 patent. Another example is shown in FIG. 1B, wherein the screen 20 is shown in use with device 10". In this embodiment, the screen 20 is arched to further assist with supporting itself over span of the gutter G. It is appreciated that in other exemplary embodiments the screens of the present invention with manipulations and groups of manipulations can be utilized with any conventional debris preclusion device that uses a screen.

Figure 3:
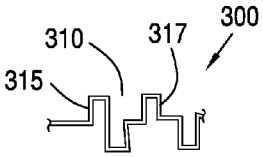
FIG. 3 displays a cross-section of another possible manipulation shape for a portion of the device of FIG. 1, having double flattened ridges and double flattened depressions.

FIG. 3 displays a cross-section 300 of another possible manipulation shape 310 of a portion of the screen 20 of the device 10 of FIG. 1, having double flattened ridges and double flattened depressions, and in view of the above is understood to be self-explanatory. This embodiment's manipulation 310 is composed of two different ridge shapes 315 and 317, where ridge shape 317 is multi-tiered, having significantly more surface area than the embodiment shown in FIG. 2.

Figure 4:
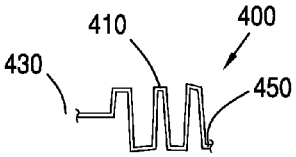
FIG. 4 displays a cross-section of another possible manipulation shape for a portion of the device of FIG. 1, having triple flattened ridges and double flattened depressions.

FIG. 4 displays a cross-section 400 of another possible manipulation shape 410 of a portion of the screen 20 of the device 10 of FIG. 1, having triple flattened ridges and double flattened depressions, and in view of the above is understood to be self-explanatory. It is noted in this example that one side 430 of the portion of the screen 20 is at a higher elevation than the other side 450 of the portion of the screen 20.

Figure 5:
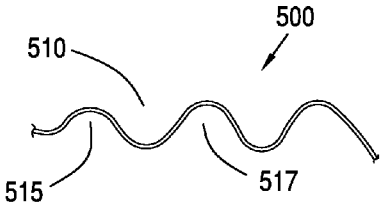
FIG. 5 displays a cross-section of another possible manipulation shape for a portion of the device of FIG. 1, having triple "rounded" ridges and double "rounded" depressions.

FIG. 5 displays a cross-section 500 of another possible manipulation shape 510 of a portion of the screen 20 of the device 10 of FIG. 1, having triple "rounded" ridges and double "rounded" depressions, and in view of the above is understood to be self-explanatory. Here, the manipulation 510 is shown with a succeeding elevation surface 517 higher than the preceding elevation surface 515.

Figure 6:
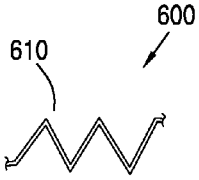
FIG. 6 displays a cross-section of another possible manipulation shape for a portion of the device of FIG. 1, having double peaks and accompanying reverse peak ridges.

FIG. 6 displays a cross-section 600 of another possible manipulation shape 610 of the portion of the screen 20 of the device 10 of FIG. 1, having double peaks and accompanying reverse peak ridges, and in view of the above is understood to be self-explanatory. Of note is that the different ends of the portion of the screen 20 can be at different elevations, according to design preference.

Figure 7:
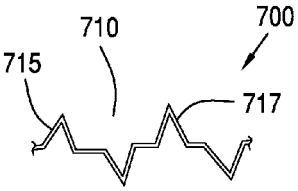
FIG. 7 displays a cross-section of another possible manipulation shape for a portion of the device of FIG. 1, having a series of alternating and reverse peaked ridges.

FIG. 7 displays a cross-section 700 of another possible manipulation shape 710 of a portion of the screen 20 of the device 10 of FIG. 1, having a series of alternating and reverse peaked ridges, and in view of the above is understood to be self-explanatory. Here, manipulation 710 is composed of a duplicated pattern 715, 717 which overlaid with an inverted form to generate the manipulation 710.

Figure 8:
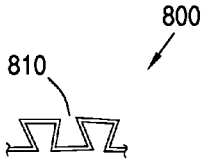
FIG. 8 displays a cross-section of another possible manipulation shape for a portion of the device of FIG. 1, having double trapezoidal ridges.

FIG. 8 displays a cross-section 800 of another possible manipulation shape 810 of a portion of the screen 20 of the device 10 of FIG. 1, having double trapezoidal ridges, and in view of the above is understood to be self-explanatory.

Figure 9:
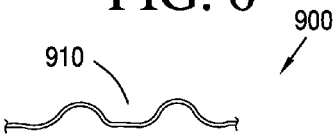
FIG. 9 displays a cross-section of another possible manipulation shape for a portion of the device of FIG. 1, having double "soft" ridges.

FIG. 9 displays a cross-section 900 of another possible manipulation shape 910 of a portion of the screen 20 of the device 10 of FIG. 1, having double "soft" ridges, and in view of the above is understood to be self-explanatory.

Figure 10:
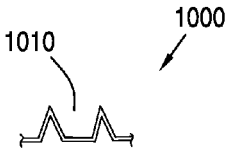
FIG. 10 displays a cross-section of another possible manipulation shape for a portion of the device of FIG. 1, having double triangular-shaped ridges.

FIG. 10 displays a cross-section 1000 of another possible manipulation shape 1010 of a portion of the screen 20 of the device 10 of FIG. 1, having double triangular-shaped ridges, and in view of the above is understood to be self-explanatory.

The above embodiments are understood to represent various non-limiting shapes for a manipulation used in screen 20 that provide a mechanism to elevate debris from the lower surface of the screen 20, which creates a means for the debris to dry and thereby be more easily carried off the device 10 by a breeze or wind. As stated above, the manipulation can be one or more shapes having a cross-sectional profile and a longitudinal profile, formed into the screen 20, and in some embodiments can be a single shape, multiple shapes, multiple different shapes and so forth. The manipulations can be repeated or combined to form groups (or sets) of manipulations, which can be identically patterned along the length of the screen and/or differently patterned along the length of the screen, with various combinations and/or angles thereof, according to design preference. Aspects of these variations, grouping and patterns will be more evident in the below Figures.

It should be appreciated that the manipulation may be composed of one or more ridges (or elevated surface(s)) that can be higher than shown if the width span of the opening of the gutter G is greater than a standard gutter. For example, a standard gutter width opening is approximately five (5) inches at the top, but some commercial gutter openings at the top can span upwards of ten (10) inches. In this case, the manipulation ridges (or protrusions) can be up to twice as tall and twice as wide, thus creating more strength for support. The following figures illustrate embodiments with screen side profiles that are nearly twice as tall and wide for these larger commercial gutter openings.

Figure 11:
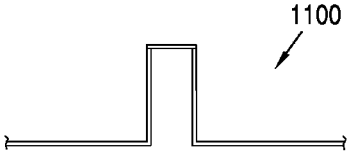
FIG. 11 displays a cross-section of a doubled height and width sized manipulation of the manipulation of FIG. 2.

FIG. 11 displays a cross-section 1100 of a doubled height and width sized manipulation 1110 of the manipulation of FIG. 2, and in view of the above is understood to be self-explanatory. In some embodiments, the "ridge" or "protruding" manipulation may be disposed nearer to an end of the device 10 (closer to shingle S or channel 30), depending on implementation preference.

Figure 12:
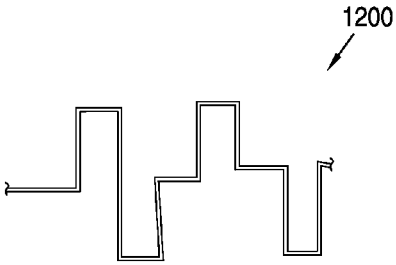
FIG. 12 displays a cross-section of a doubled height and width sized manipulation of the manipulation of FIG. 3.

FIG. 12 displays a cross-section 1200 of a doubled height and width sized manipulation 1210 of the manipulation of FIG. 3, and in view of the above is understood to be self-explanatory.

Figure 13:
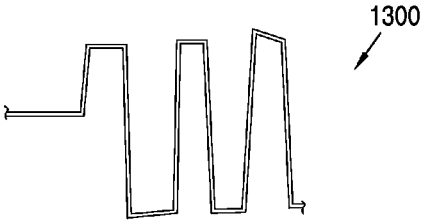
FIG. 13 displays a cross-section of a doubled height and width sized manipulation of the manipulation of FIG. 4.

FIG. 13 displays a cross-section 1300 of a doubled height and width sized manipulation 1310 of the manipulation of FIG. 4, and in view of the above is understood to be self-explanatory.

Figure 14:
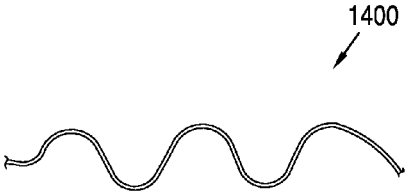
FIG. 14 displays a cross-section of a doubled height and width sized manipulation of the manipulation of FIG. 5.

FIG. 14 displays a cross-section 1400 of a doubled height and width sized manipulation 1410 of the manipulation of FIG. 5, and in view of the above is understood to be self-explanatory.

Figure 15:
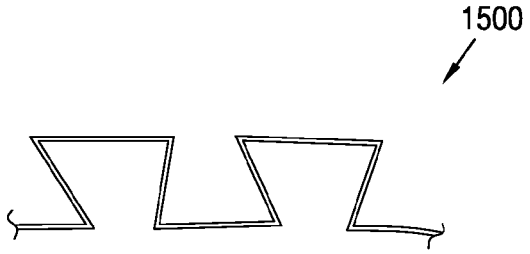
FIG. 15 displays a cross-section of a doubled height and width sized manipulation of the manipulation of FIG. 8.

FIG. 15 displays a cross-section 1500 of a doubled height and width sized manipulation 1510 of the manipulation of FIG. 8, and in view of the above is understood to be self-explanatory.

Figure 16:
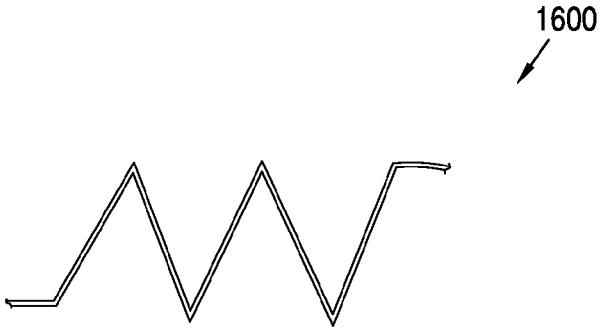
FIG. 16 displays a cross-section of a doubled height and width sized manipulation of the manipulation of FIG. 6.

FIG. 16 displays a cross-section 1600 of a doubled height and width sized manipulation 1610 of the manipulation of FIG. 6, and in view of the above is understood to be self-explanatory.

Figure 17:
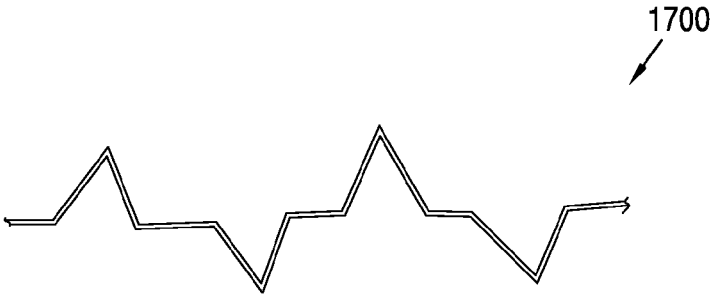
FIG. 17 displays a cross-section of a doubled height and width sized manipulation of the manipulation of FIG. 7.

FIG. 17 displays a cross-section 1700 of a doubled height and width sized manipulation 1710 of the manipulation of FIG. 7, and in view of the above is understood to be self-explanatory.

Figure 18:
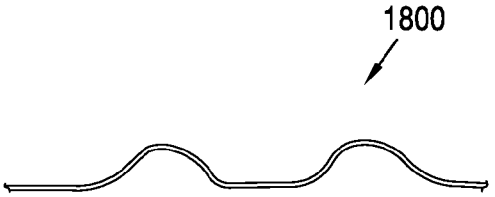
FIG. 18 displays a cross-section of a doubled height and width sized manipulation of the manipulation of FIG. 9.

FIG. 18 displays a cross-section 1800 of a doubled height and width sized manipulation 1810 of the manipulation of FIG. 9, and in view of the above is understood to be self-explanatory.

Figure 19:
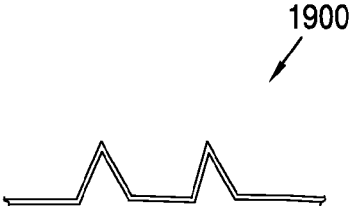
FIG. 19 displays a cross-section of a doubled height and width sized manipulation of the manipulation of FIG. 10.

FIG. 19 displays a cross-section 1900 of a doubled height and width sized manipulation 1910 of the manipulation of FIG. 10, and in view of the above is understood to be self-explanatory.

From a top view, the manipulations in the screen 20 can run in any direction, and any shape between the roofline and the front lip of the gutter G. Sets (or groups) of a given manipulation (or pattern thereof) can be arranged in a uniform manner or non-uniform manner. The arrangement can alter the angles of the respective manipulation/group (and/or pattern) to form crisscrossing manipulations or staggered manipulations with altered orientations. The variations of the patterns of manipulations could be suited for differing areas of homes where there are differing types of trees with leaves and pine needles (e.g., differently sized and differently shaped debris). The ridge pattern(s) allow for the larger leaves to sit on the flatter surfaces with a portion of the leaf resting on the ridge. The combination of the ridge shape and pattern enables multi-sized debris to be effectively precluded. As non-limiting examples, the following figures illustrate different orientations and patterns or arrangements of the manipulations.

Figure 20:
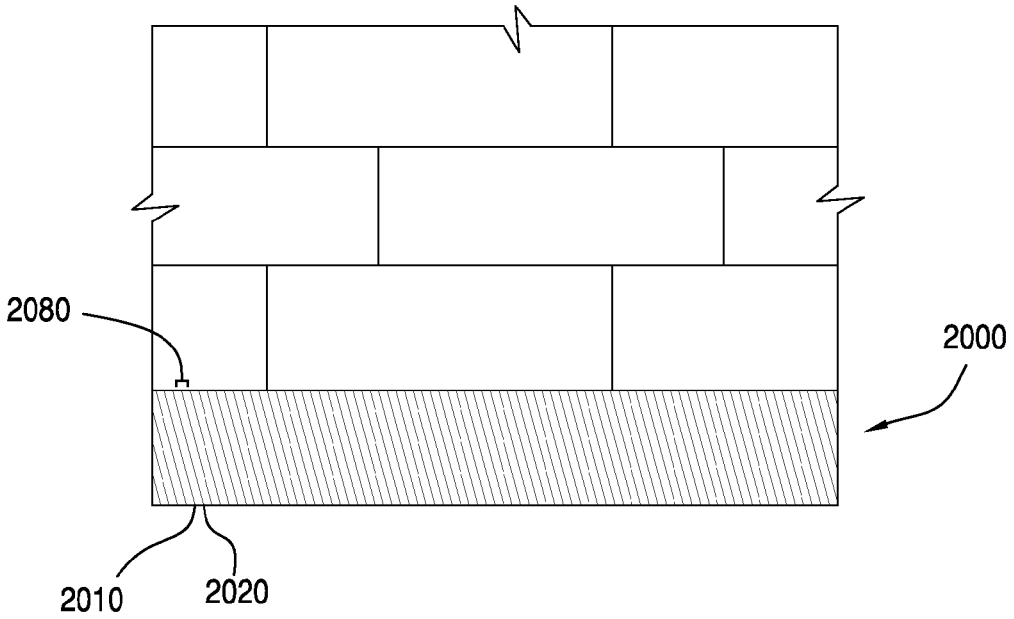
FIG. 20 displays a top view of an embodiment with a pattern of regularly spaced manipulations oriented at an arbitrary angle.

FIG. 20 displays a top view of an embodiment 2000 with regularly spaced, adjacent manipulations 2010, 2020 set at an arbitrary angle between 0-90 degrees relative to a longitudinal edge of the screen 20. Here, they are illustrated at approximately 80 degrees relative to a longitudinal edge of the screen 20. A group 2080 formed by the manipulations 2010, 2020, which are shown in this example as identical manipulations, can be replicated along the screen 20.

Figure 21:
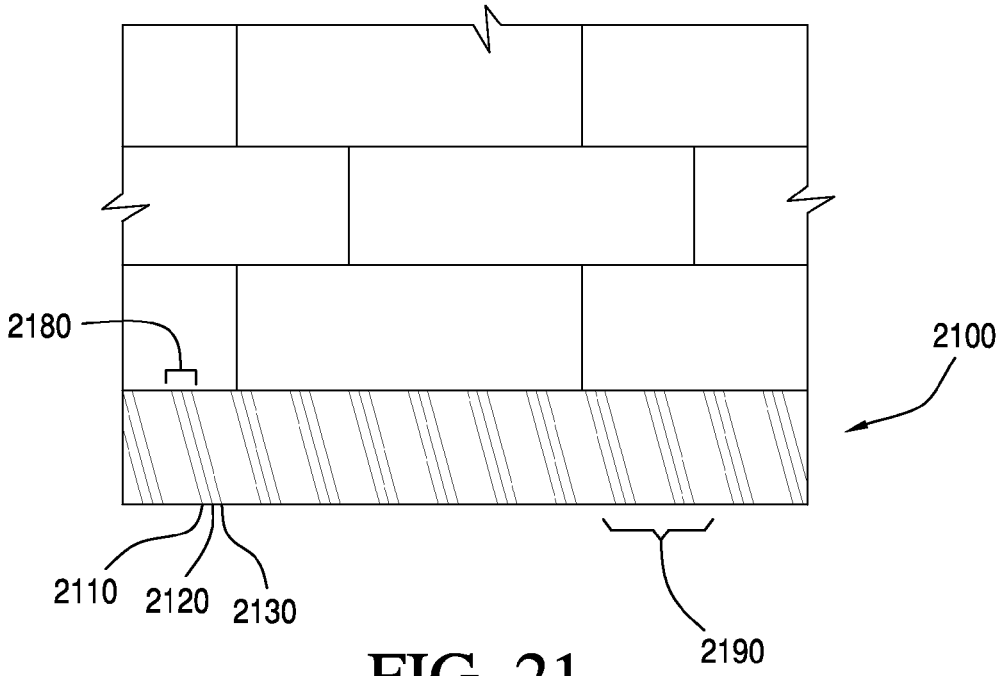
FIG. 21 displays a top view of an embodiment with a pattern of offset spaced manipulations oriented at an arbitrary angle.

FIG. 21 displays a top view of an embodiment 2100 with regularly spaced manipulations 2110, 2120, 2130 set an arbitrary angle. Here, they are illustrated at approximately 80 degrees relative to a longitudinal edge of the screen 20. A group 2180 is formed by the adjacent manipulations 2110, 2120, 2130 that is replicated along the screen 20, but in a pattern 2190 with an intermediate offset between adjacent groups 2180.

Figure 22:
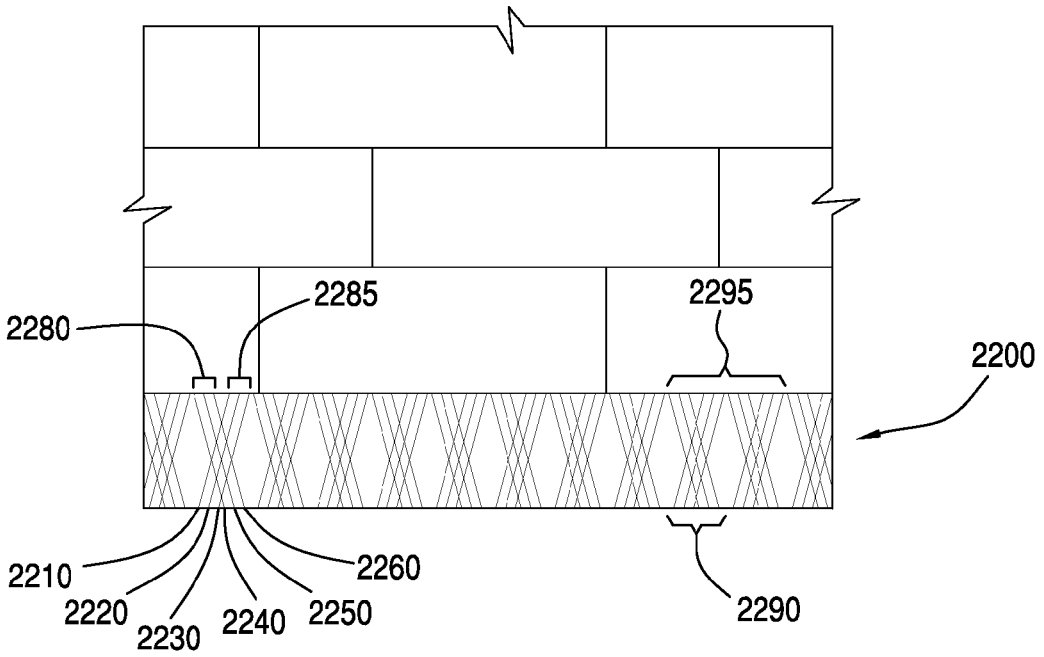
FIG. 22 displays a top view of an embodiment with a pattern of regularly spaced manipulations set at opposing angles to form a cross-hatched pattern.

FIG. 22 displays a top view of an embodiment 2200 with sets of regularly spaced manipulations 2210, 2220, 2230 which intersect with manipulations 2240, 2250, 2260. Groups 2280, 2285 are formed by the aforementioned manipulations to arrive at a pattern 2290, which is replicated in alignment 2295 along screen 20. It is evident that groups 2280, 2285 are arranged at opposing angles to form a cross-hatched pattern 2290. Here, they are illustrated at approximately 80 degrees relative to a longitudinal edge of the screen. In other embodiments, the groups 2280, 2285 may be oriented at different angles, and pattern 2290 may be replicated in an offset or angled manner, according to design preference. The crossing pattern is well suited for homes where there are many trees with either leaves or pine needles. The crossing ridges allow for many surfaces to assist in holding up larger amounts of leaves and pine needles.

Figure 23:
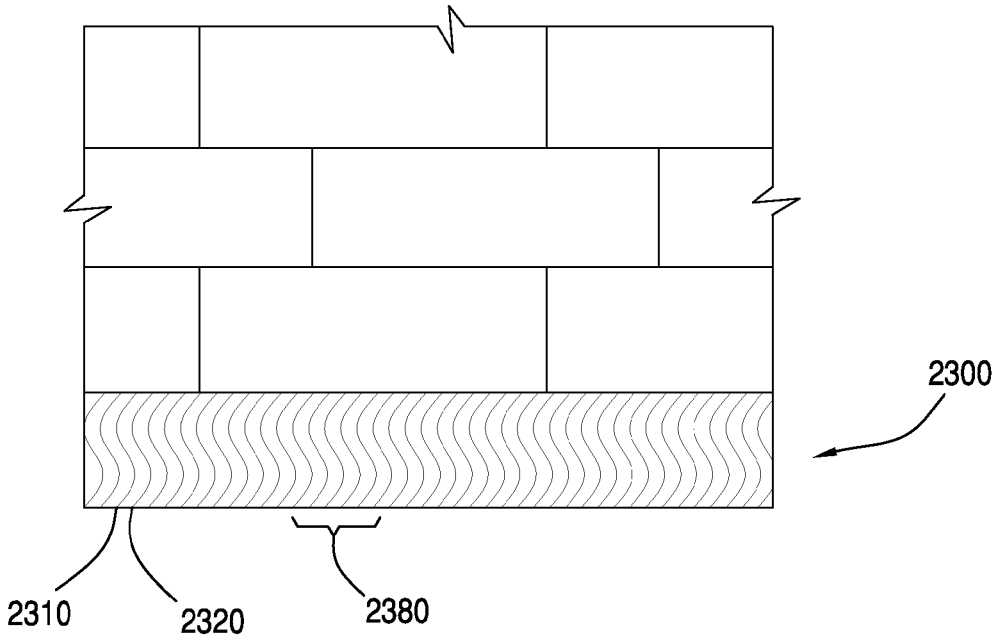
FIG. 23 displays a top view of an embodiment with a pattern of regularly spaced manipulations arranged in a curved pattern.

FIG. 23 displays a top view of an embodiment 2300 with regularly spaced manipulations 2310, 2320 arranged in a curved "S" shape. This pattern 2380 is well suited for areas of homes where there are higher rainfall amounts. The "S" shape can help slow down the rain coming down from the roof R and across the screen 20. In addition, the shape also can act as a supporting feature to hold the screen 20 above the gutter G without a support structure.

Figure 24:
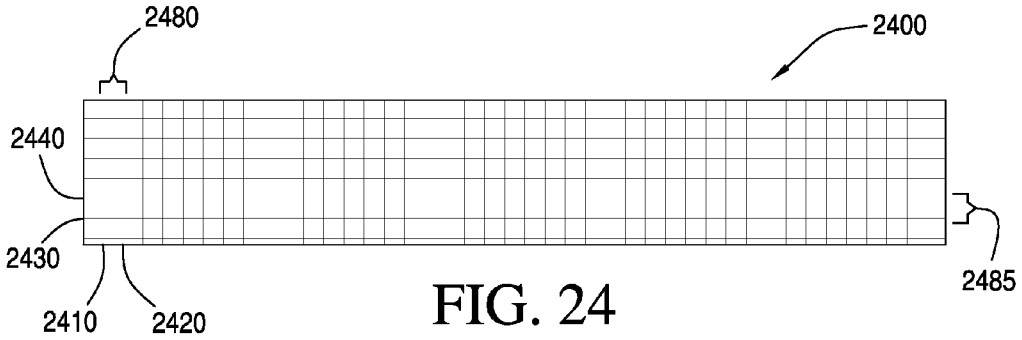
FIG. 24 displays a top view of an embodiment with a pattern of regularly spaced manipulations arranged to orthogonally cross each other.

FIG. 24 displays a top view of an embodiment 2400 with regularly spaced manipulations 2410, 2420 and 2430, 2440 arranged to orthogonally cross each other. Groups 2480 and 2485 formed from the manipulations and due to the orthogonal orientation, form a tile pattern. Of course, as in this and the other embodiments described, different angles may be implemented without departing from the spirit and scope of this disclosure.

Figure 25:
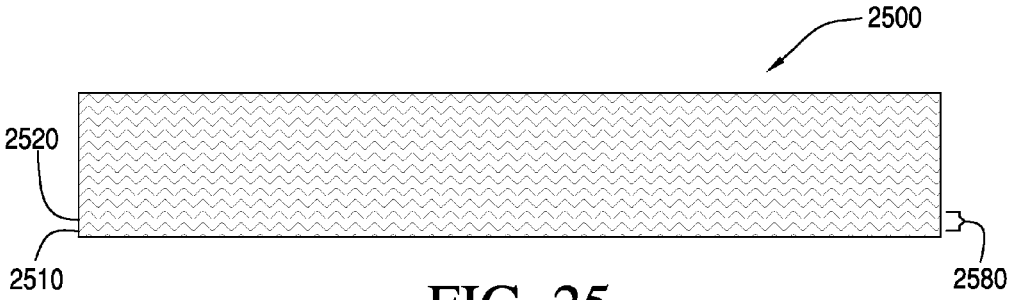
FIG. 25 displays a top view of an embodiment with a pattern of regularly spaced manipulations arranged in a zig-zag pattern along a longitudinal direction of the gutter G.

FIG. 25 displays a top view of an embodiment 2500 with regularly spaced manipulations 2510, 2520 arranged in a zig-zag format along a longitudinal direction of the gutter G. Group 2580 is formed using manipulations 2510 and 2520 replicated in-kind to form the pattern shown.

Figure 26:
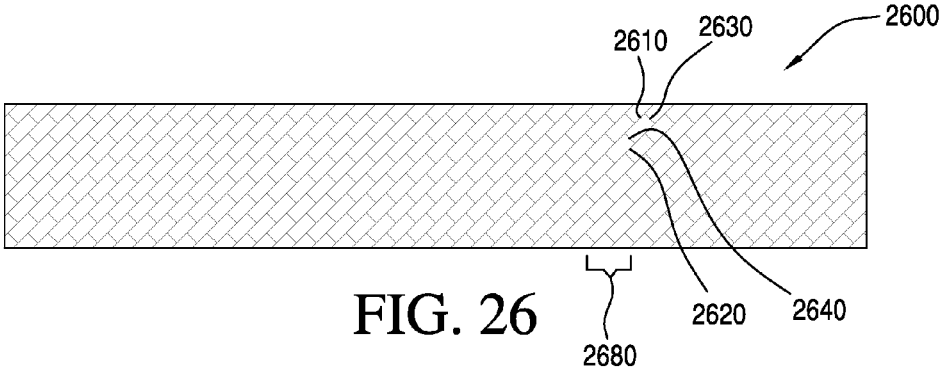
FIG. 26 displays a top view of an embodiment with a pattern of regularly spaced manipulations arranged offset and angled from each other, forming a brick-like or block-like pattern.

FIG. 26 displays a top view of an embodiment 2600 with parallel manipulations 2610, 2620 and orthogonal parallel manipulations 2630, 2640 arranged in an offset angled format, to form a brick-like group which is replicated as pattern 2680 along the screen 20.

Figure 27:
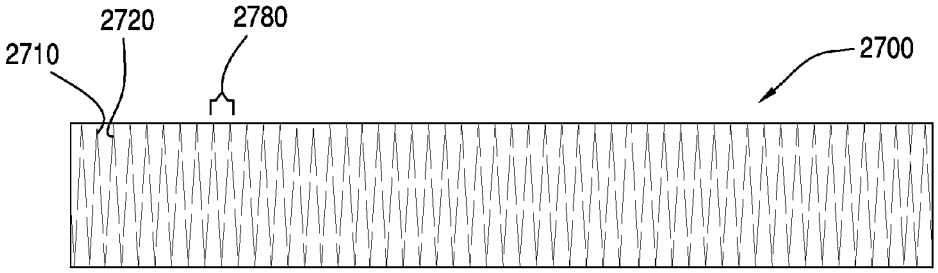
FIG. 27 displays a top view of an embodiment with a pattern of regularly spaced manipulations arranged in acute angles to each other, forming an accordion-like pattern.

FIG. 27 displays a top view of an embodiment 2700 with manipulations 2710, 2720 arranged in acute angles to each other, forming an apexed group 2780, which is replicated to form the shown accordion-like pattern.

Figure 28:
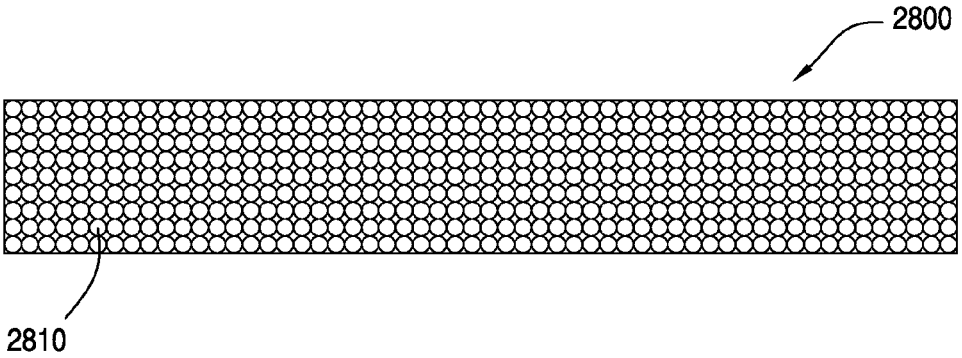
FIG. 28 displays a top view of an embodiment with a pattern of adjacent circular manipulations.

FIG. 28 displays an alternate embodiment 2800 with circularly shaped manipulations 2810, and in view of the above is understood to be self-explanatory. For example, manipulation 2810 can be of a non-linear geometric form (for example, circle, dome, arc, ellipse, etc.) that is arranged in linearly repeating form along screen 20 to provide elevated surfaces for debris removal. In some embodiments, the respective manipulations 2810 may be offset to form a honeycomb-like structure.

Figure 29:
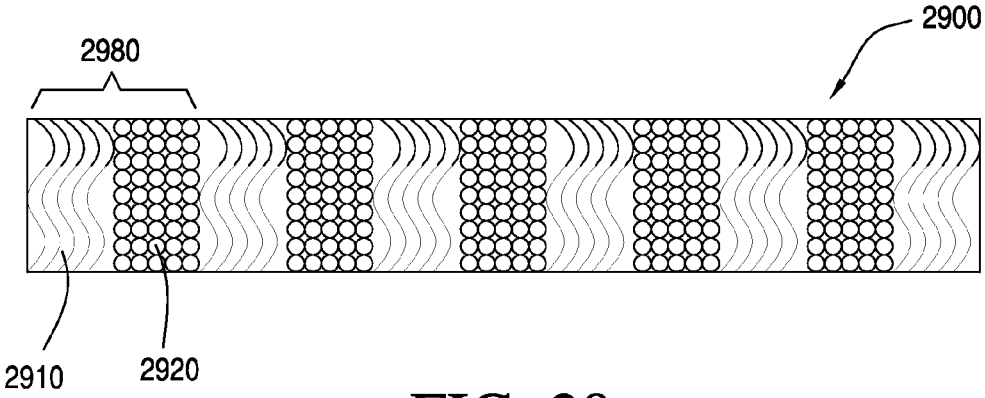
FIG. 29 displays a top view of an embodiment with a combination of patterns of manipulations.

FIG. 29 displays an alternate embodiment 2900 with a combination of sequenced manipulations 2910, 2920 and in view of the above is understood to be self-explanatory. For example, the group of manipulations 2910 is composed of S shapes while the group of manipulations 2920 is composed of dome shapes. A super group 2980 (or pattern) is formed by the combination of the respective manipulation groups. The super group 2980 is repeated at uniform intervals along the screen 20.

Figure 30:
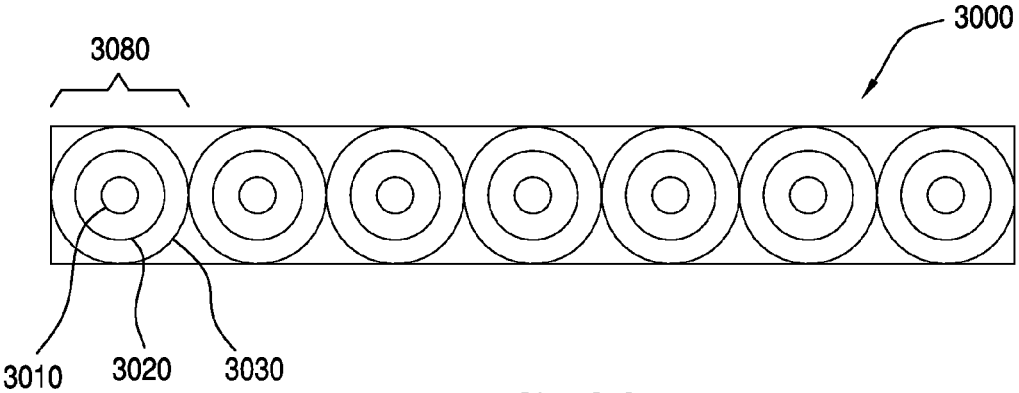
FIG. 30 displays a top view of an embodiment with concentric manipulations.

FIG. 30 displays an alternate embodiment 3000 with manipulations 3010, 3020, 3030 composed of concentric raised circles and/or domes. The set or group 3080 of manipulations 3010, 3020, 3030 are repeated in equally spaced adjoining pattern along screen 20.

Figure 31:
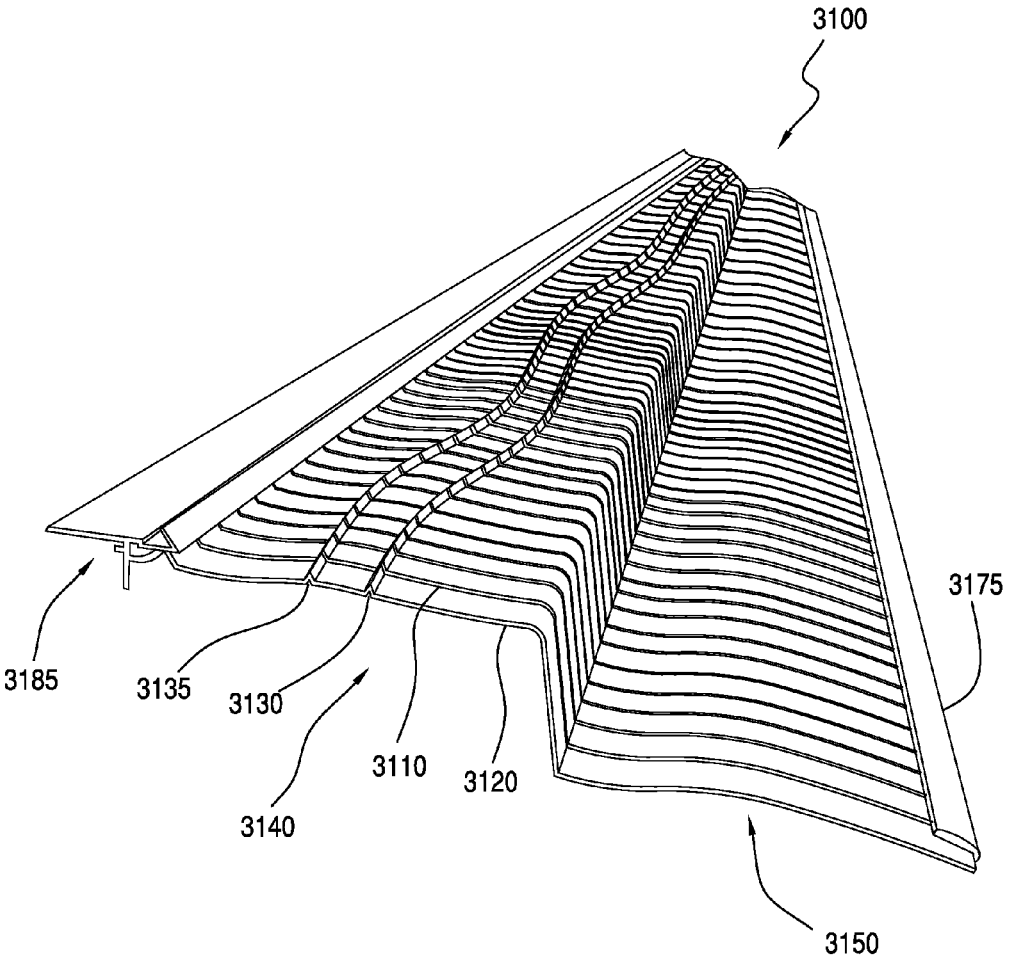
FIG. 31 displays a cross sectional view of an alternate embodiment having a tiered profile.

FIG. 31 displays an alternate embodiment 3100 having a tiered profile, attached to a gutter (not shown) via attachment edges 3175, 3185, the specifics of which are well known in the art. Manipulations 3110, 3135 are arranged from gutter lip-to-lip, being uniformly spaced along the gutter length. Secondary manipulations 3130, 3135 are disposed on upper tier section 3130 in a transverse orientation from manipulations 3110, 3120 and run along the gutter length. Secondary manipulations 3130, 3125 are shown as an S-shape but may be of any desired shape. Further, more or less (or different) shapes may be utilized. Upper and lower tiers 3140, 3150 may also have portions that are curved, as shown. In some embodiments, the screen can change its tiering to be upward (or downward, depending on implementation preference) by about a half an inch and then its direction is altered back to the back of the gutter G or under the roof line. This embodiment 3100 provides multiple large surfaces at different elevations for the manipulated ridge(s) to be formed on. The "step" formed in the screen can operate to form a macro ridge for larger debris while the manipulated ridge(s) operate on smaller debris. Of course, while FIG. 31 displays only one step, multiple steps may be implemented by one of ordinary skill in the art without departing from the spirit and scope of this disclosure.

While this invention has been described in conjunction with the specific embodiments outlined above, it is evident that many alternatives, modifications and variations will be apparent to those skilled in the art. Accordingly, the preferred embodiments of the invention, as set forth above, are intended to be illustrative, not limiting. Various changes and combinations thereof may be made without departing from the spirit and scope of this invention. It should be apparent that various different modifications can be made to the exemplary embodiments described herein without departing from the scope and spirit of this invention disclosure. When structures are identified as a means to perform a function, the identification is intended to include all structures, which can perform the function specified.

What is claimed is:

1. A gutter debris preclusion device for debris elevation for enhancing debris drying and removal that is for use with a gutter, comprising:

a metal woven screen having a plurality of uniformly spaced and uniformly sized orifices disposed therein, the screen having a longitudinal and lateral direction;

a first manipulation disposed in the screen and having a first cross-sectional shape along a first portion in the lateral direction of the screen, the first cross-sectional shape having a first upward extending peak;

a second manipulation disposed in the screen and having a second cross-sectional shape along a second portion in the lateral direction of the screen, the second cross-sectional shape having a second upward extending peak, a first pattern having at least one ridge, semi or fully directed longitudinally, along sections of the screen, formed by combining the first and second cross-sectional shapes and shifting the combination across the longitudinal direction of the screen; and, wherein the at least one ridge redirects water to flow with a longitudinal component over the screen, and the at least one ridge elevates one or more portions of a resting debris to permit airflow between the elevated portion(s) of the resting debris and a non-contact area of the screen, facilitating accelerated drying and wind-based removal of the debris from the screen.

2. The gutter debris preclusion device, as recited in claim 1, wherein the first cross-sectional shape is the same as the second cross-sectional shape.

3. The gutter debris preclusion device, as recited in claim 1, further comprising a second ridge in the first pattern.

4. The gutter debris preclusion device, as recited in claim 3, wherein the first cross-sectional shape is the same as the second cross-sectional shape, and ridges of the at least one ridge are shaped differently from each other.

5. The gutter debris preclusion device, as recited in claim 1, wherein the device is fully self-supporting over a gutter, due to the screen itself being fully self-supporting, or due to at least one of the first and second cross sectional shapes stiffening the screen to become fully self-supporting.

6. The gutter debris preclusion device, as recited in claim 1, further comprising a second pattern having at least one ridge, semi or fully directed longitudinally, along sections of the screen, formed by combining the first and second cross-sectional shapes and shifting in a different manner from the first pattern, the combination across the longitudinal direction of the screen to form a repeating second pattern on the screen.

7. The gutter debris preclusion device, as recited in claim 6, wherein the first pattern and the second pattern are of the same overall shape.

8. The gutter debris preclusion device, as recited in claim 1, wherein a number of the screen's orifices are between 196 to 8,200 per square inch of the screen.

9. The gutter debris preclusion device, as recited in claim 1, wherein the first pattern forms a sinusoidal curve.

10. A gutter debris preclusion device for securing to a top portion of a roof gutter that is attached to a building for keeping leaves and other debris out of the roof gutter, comprising:

a woven metal screen with fenestrations uniformly spaced and uniformly sized allowing water to pass through into the roof gutter, the mesh having a longitudinal and lateral direction; and a first manipulation and second manipulation integrally and one-piece formed of a portion of the screen, the first manipulation having a lateral first cross section having a first upward extending ridge and a first length, the second manipulation having a lateral second cross section having a second upward extending ridge and a second length, wherein at least the first and second manipulations contain an elevated region that is at least 0.125 inches tall and provides a tilt angle of between 0 to 45 degrees for leaves or debris resting on the screen, wherein the first and second cross sections of the manipulations are shifted along the first and second lengths as a function of longitudinal displacement along the screen to form a first pattern of manipulations along a longitudinal direction of the screen, wherein a ridge from the first pattern causes one or more portions of resting debris to be elevated over the screen so as to permit airflow between the elevated portion(s) of the resting debris and a non-contact area of the screen, facilitating accelerated drying of the debris to enhance being blown off the roof gutter, and the ridge assists in directing water to flow with a longitudinal component over the screen.

11. The gutter debris preclusion device as recited in claim 10, wherein the first and second manipulations form a group or set of manipulations.

12. The gutter debris preclusion device as recited in claim 11, wherein the group or set of manipulations is repeated to form a plurality of patterns.

13. The gutter debris preclusion device as recited in claim 1, wherein at least one of the first and second elevated peaks is at least 0.125 inches in height from a top surface of the screen.

14. The gutter debris preclusion device as recited in claim 10, wherein a cross section of at least one of the first and second manipulations is at least one of a truncated rectangle, a plurality of adjoining truncated rectangles displaced from each other by a fixed separation distance, a plurality of truncated rectangles that are multi-sized, a plurality of adjoining arcs, a plurality of adjoining angles, a plurality of truncated trapezoids, an S-shape, a circle, and a plurality of concentric circles.

15. The gutter debris preclusion device as recited in claim 10, wherein the screen is between approximately 5 inches to 10 inches wide.

16. The gutter debris preclusion device as recited in claim 12, wherein one or more groups or patterns is displaced and repeated from a prior group or pattern to intersect the prior group or pattern.

17. The gutter debris preclusion device as recited in claim 12, wherein one or more of the groups or patterns is displaced and repeated from a prior group or pattern at a dissimilar angle.

18. The gutter debris preclusion device as recited in claim 12, wherein the group or patterns form a shape of at least one of a cross hatch, an S, a tile, a zig-zag, a brick, a block, an accordion, and circles.

19. The gutter debris preclusion device as recited in claim 10, wherein the screen is tiered with an upper portion and a lower portion, wherein at least one of the first and second manipulations span the upper and lower portion, and wherein at least one of the first and second manipulations is constrained to either the upper portion or lower portion.

20. A method for gutter debris preclusion for use with a gutter, comprising:

installing a gutter debris preclusion device to a gutter, wherein the device includes a metal screen composed of a plurality of equally spaced and uniformly sized orifices, the screen having a lateral and longitudinal direction, wherein the screen includes a first manipulation being formed in a lateral and longitudinal direction of the screen to form a first longitudinally directed shape, the first manipulation having a first cross-sectional shape with a first upward extending ridge, wherein the screen includes a second manipulation being formed in the lateral and longitudinal direction of the screen to form a second longitudinally directed shape, the second manipulation having a second cross-sectional shape with a second upward extending ridge, and the screen includes at least a first pattern along a longitudinal direction of the screen being formed by a combination of the first and second manipulations' shapes, wherein at least one of the first and second ridges in the at least first pattern forms peaks to elevate one or more portions of a resting debris to permit airflow between the elevated portion(s) of the resting debris and a non-contact area of the screen, facilitating accelerated drying and wind-based removal of the debris from the screen.

* * * * *